United States Patent [19]

Vaughn et al.

[11] 3,935,687

[45] Feb. 3, 1976

[54] PLATFORM TENNIS COURT

[75] Inventors: George A. Vaughn; Richard D. Hargrave, both of Princeton, N.J.

[73] Assignee: Maark Corporation, Plainsboro, N.J.

[22] Filed: Sept. 13, 1974

[21] Appl. No.: 505,796

Related U.S. Application Data

[60] Continuation of Ser. No. 352,266, April 18, 1973, abandoned, which is a division of Ser. No. 211,028, Dec. 21, 1971, Pat. No. 3,745,729.

[52] U.S. Cl. ..... 52/483; 272/3; 273/29 R

[51] Int. Cl.[2] ..... E04B 5/43

[58] Field of Search ..... 52/483, 481, 480, 474, 52/274, 299; 14/6, 73; 272/3; 273/29 R

[56] References Cited

UNITED STATES PATENTS

| | | | |
|---|---|---|---|
| 1,900,721 | 3/1933 | Manske et al. | 52/489 X |
| 1,939,732 | 12/1933 | Stresau | 52/483 |
| 1,941,967 | 1/1934 | Bell | 52/483 X |
| 2,205,109 | 6/1940 | Rugg et al. | 52/483 X |
| 2,205,398 | 6/1940 | Eaton | 52/646 X |
| 3,067,843 | 12/1962 | Rushtoh et al. | 52/474 X |
| 3,302,361 | 2/1967 | Oudheusden et al. | 52/488 X |
| 3,420,025 | 1/1969 | Portz | 52/483 X |
| 3,745,729 | 7/1973 | Vaughn et al. | 52/273 X |

*Primary Examiner*—Price C. Faw, Jr.
*Attorney, Agent, or Firm*—Bain, Gilfillan & Rhodes

[57] ABSTRACT

Metal support apparatus including a plurality of structurally interrelated metal members with each metal member being of a predetermined configuration. Also disclosed is a metal (e.g. aluminum) platform tennis court including a plurality of such above-mentioned metal support apparatus on the deck or playing surface of the court, such metal deck or playing surface providing, over the entire area thereof, a more uniform deflection in response to the weight or force of a running player than a wooden playing surface or deck of a wooden platform tennis court. Such metal platform tennis court also including means provided on the screen vertical support members for tensioning the screen which, unlike the prior art, is not bolted through the deck of the platform tennis court thereby permitting the screen tension to be adjusted by one operator residing on the deck and also permitting the screen to remain in a tensioned condition or fully secured condition during disassembly and transport thus precluding screen tangling or fouling.

6 Claims, 7 Drawing Figures

FIG. 5
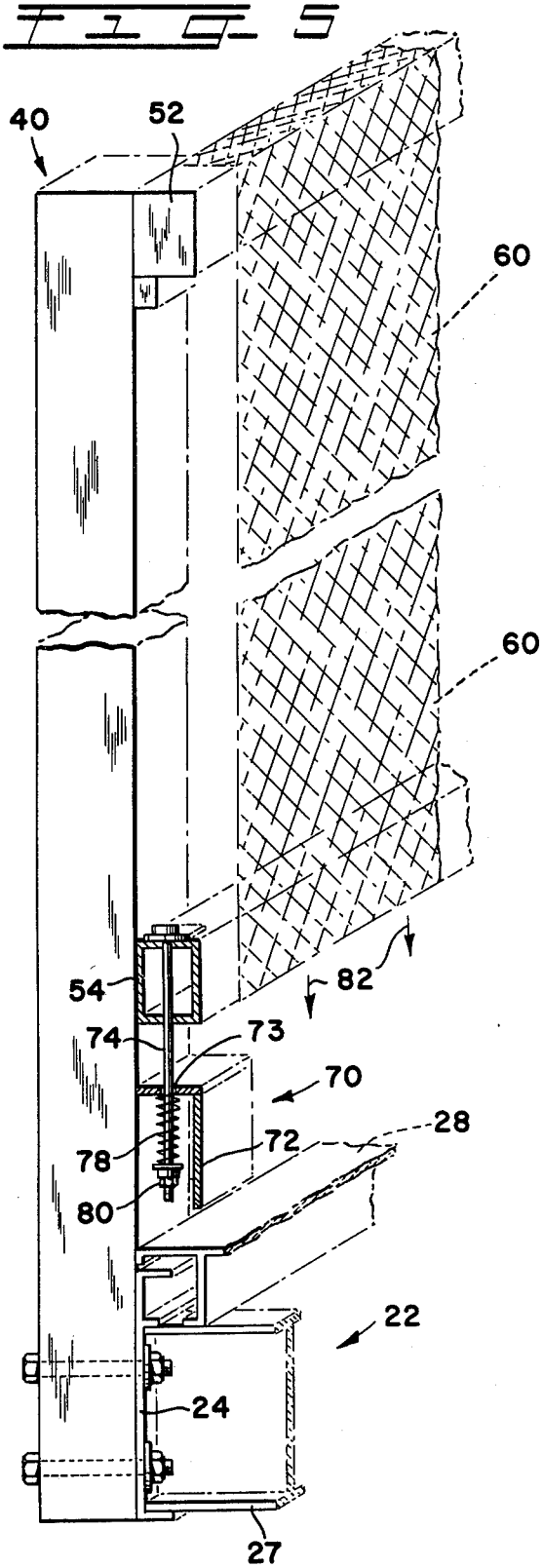
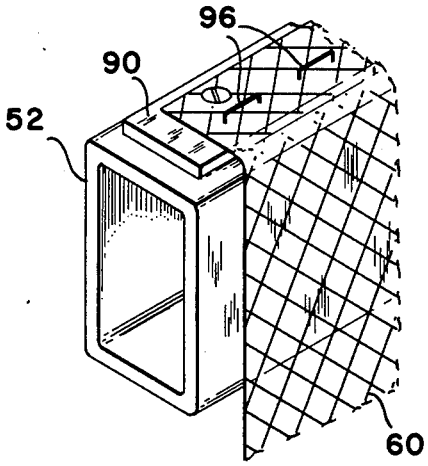
FIG. 6
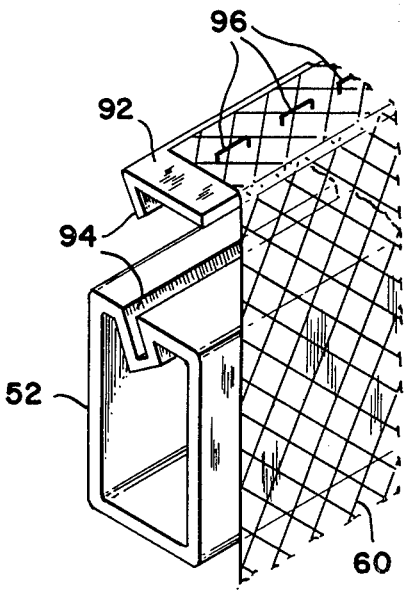
FIG. 7

PLATFORM TENNIS COURT

CROSS-REFERENCES TO RELATED APPLICATIONS

This application is a continuation of application Ser. No. 352,266, filed Apr. 18, 1973, and now abandoned, and which abandoned application was a division of application Ser. No. 211,028 filed Dec. 21, 1971, and now U.S. Pat. No. 3,745,729.

BACKGROUND OF THE INVENTION

1. Field of the Invention

This invention relates to a metal platform tennis court, to metal support apparatus a plurality of which are particularly useful for providing the deck of a metal platform tennis court, and to apparatus for supporting screen material and for maintaining the screen material in tension and which support apparatus is particularly useful with such metal platform tennis court.

2. Description of the Prior Art

Platform tennis courts are known to the prior art, in particular wooden platform tennis courts are common and have been in use for many years. As is known in the art, wooden platform tennis courts are susceptible to weather and the elements and tend to have an undesirably short life. In addition, being made of wood, and since platform tennis is typically played in the winter time, such wooden platform tennis courts are difficult to heat to enable the removal of snow since wood, as is known, is a poor conductor of heat. Further, since the typical platform tennis court is 30 by 60 feet, it must typically be built on site due to the weight of the component material and hence is not readily manufacturable in component parts for transportion to and assembly at a platform tennis court site. Further, since, as is known, commercially available wood does not typically come in dimensionally accurate configurations, a lack of uniformity of construction is commonly found in wooden platform tennis courts. Still further, wood, as is known, is more susceptible to taking a permanent bend than is metal, e.g., an aluminum alloy, and hence platform tennis courts made of wood tend to not be dimensionally stable over a long period of life. Further, the deck of the typical wood platform tennis court is comprised of 2 by 6 deck members supported by spaced joists which are in turn supported by pilings. Such a wooden deck, as is known, exhibits a non-uniform deflection at various points thereover in response to the load provided to the deck by a running player, more particularly, when a load is applied to the deck at a point immediately over that portion of a joist supported by a piling, there is no deflection in the wooden deck since the force or load is transmitted directly to ground and not through any member capable of deflection. Other portions of the wooden deck, in particular, those portions of a 2 by 6 deck plank suspended over two joists, exhibits maximum deflection and hence a player running across such a wooden deck will encounter points of great deflection and points of no deflection.

SUMMARY OF THE INVENTION

The present invention includes a metal platform tennis court wherein the integral component parts are made of a suitable metal, e.g., an aluminum alloy, and wherein the metal deck of such platform tennis court exhibits a substantially uniform deflection in response to the load applied thereto, at various points thereover, by a running or moving player. Further, the metal platform tennis court of the present invention is lighter per unit volume than a wooden platform tennis court, and, being made of metal, has greater heat conductivity thereby enhancing the removal of snow from the platform tennis court since such a metal platform tennis court may be easily and readily heated, for example, by a space heater residing below the platform tennis court deck. Further, being metal, the platform tennis court of the present invention is impervious to weather and the elements and is more dimensionally stable and does not warp as does a wooden court. Also, since it is metal it is more dimensionally stable and hence permits the application to the surface thereof of various finishes and paints. Still further, since it is made of metal, it may be manufactured at a distant location and produced in component parts, modular construction, and transported to an assembly site and readily assembled in final form.

BRIEF DESCRIPTION OF THE DRAWINGS

FIG. 5 is a schematic showing the screen and apparatus for supporting screen material and providing tension to such screen material according to the present invention, and FIGS. 6 and 7 are alternate embodiments showing various structural arrangements in supporting the top of the screen.

DESCRIPTION OF THE PREFERRED EMBODIMENT

Figure 1:
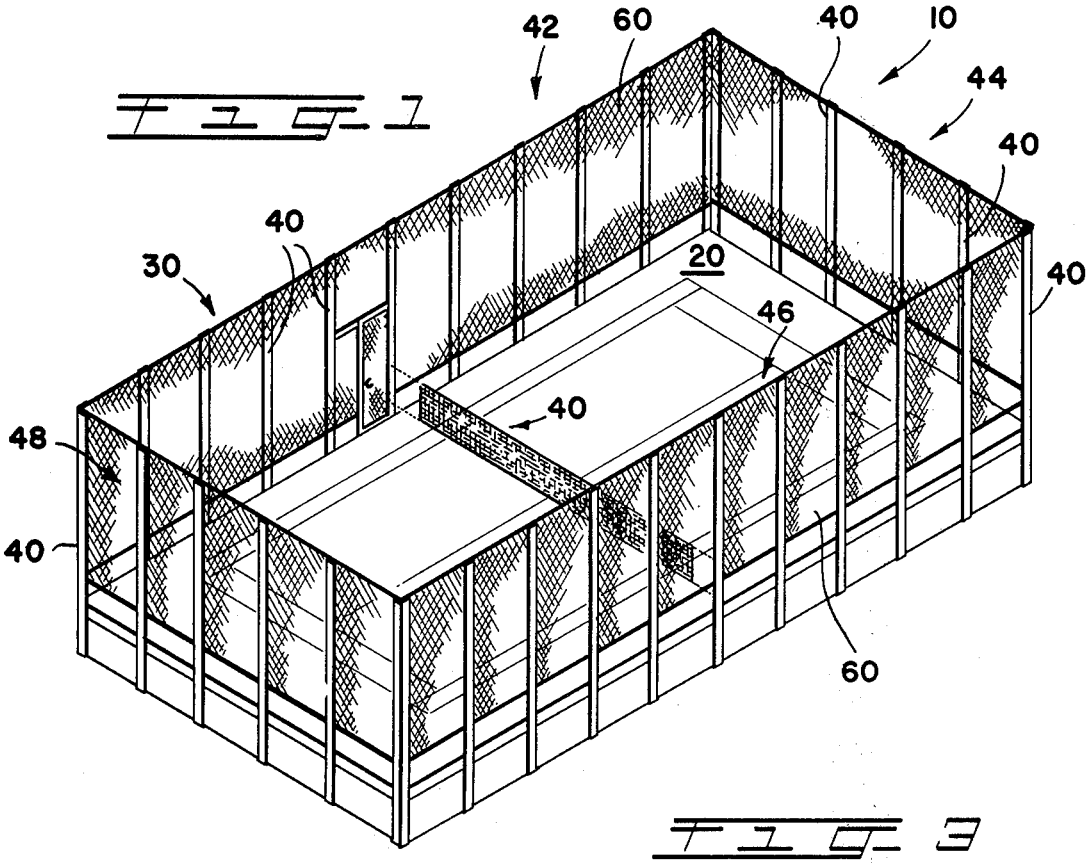
FIG. 1 shows a diagrammatic representation of a metal tennis court according to the present invention.

Referring now to FIG. 1, there is shown a metal platform tennis court 10 according to the present invention including a deck section 20 and a screen and screen support and tensioning apparatus 30; such platform tennis court may also include apparatus 40 providing a net and the support structure therefor.

Figure 2:
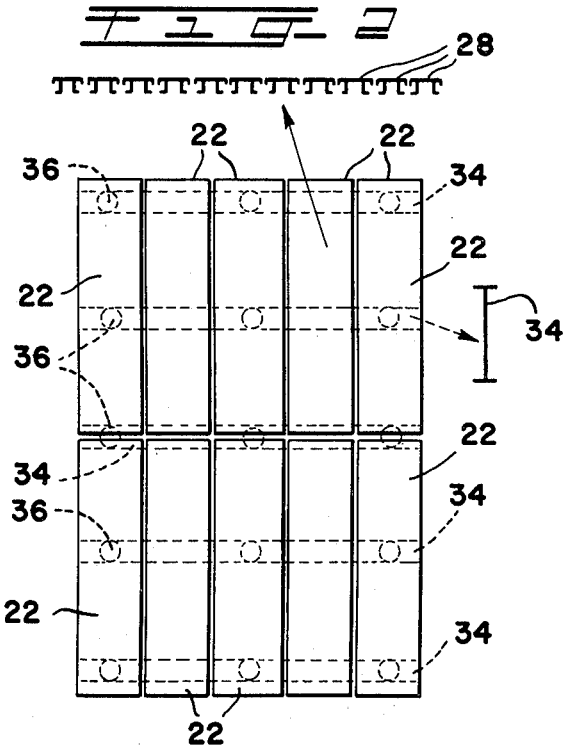
FIG. 2 shows a plurality of support apparatus, or deck panels which may provide the deck of the platform tennis court of the present invention.
Figure 3:
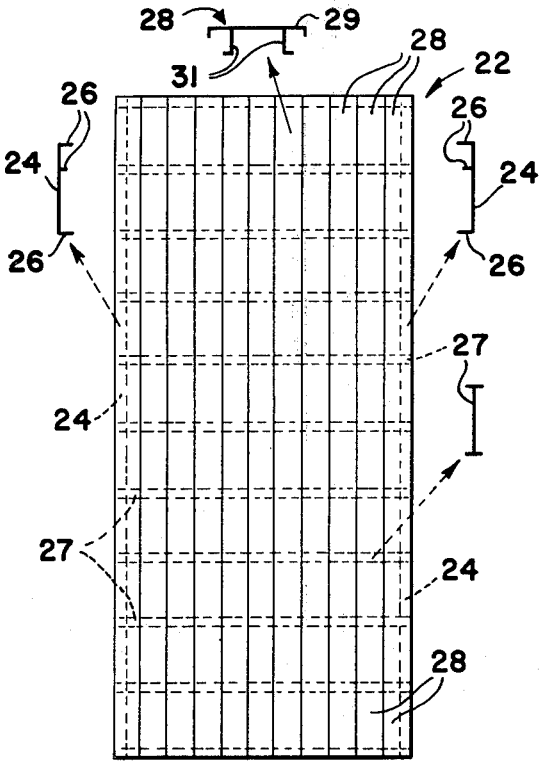
FIG. 3 is a schematic showing the structural relationships of the component parts of a support apparatus or deck panel of the present invention.
Figure 4:
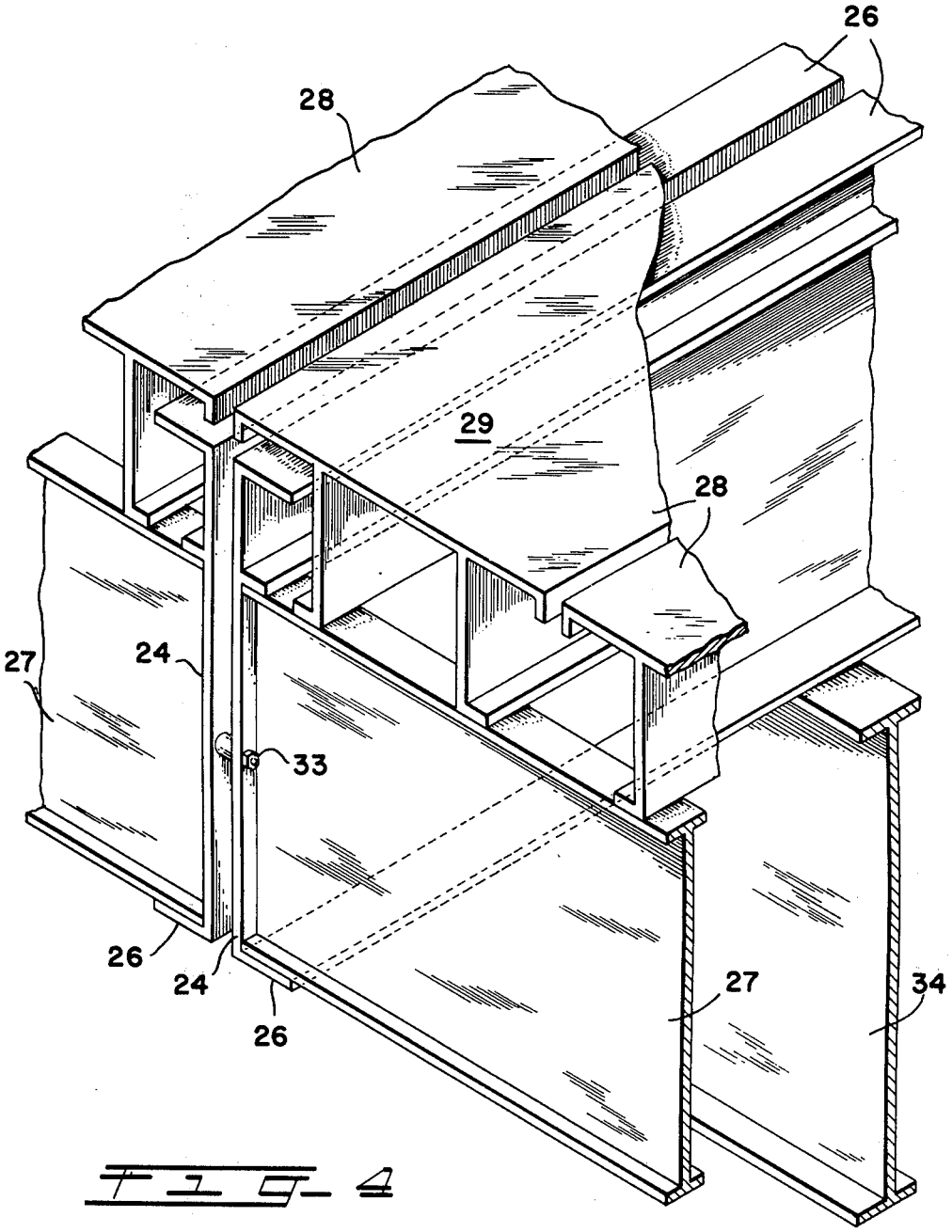
FIG. 4 is a fragmentary schematic showing in detail the structural interrelationships of the components of the support apparatus or deck panel according to the present invention.

The deck 20 may include a plurality of support apparatus or deck panels 22 as shown in FIG. 2. Each deck panel 22, as shown in FIGS. 3 and 4, may include a pair of oppositely disposed metal channel members 24 spaced apart a predetermined distance in the horizontal direction. Each channel member includes a plurality of integrally formed and horizontally disposed flanges 26 spaced apart vertically and which flanges provide the channel members with resistance to bending in the horizontal direction. Such support apparatus or deck panel further includes a plurality of vertically disposed metal joists 27 spaced apart a predetermined distance in the horizontal direction and extending between the channel members 24. The joists are fixedly secured to the channel members, for example, such as by welding. The support apparatus or deck panels 22 further includes a plurality of metal deck members 28 spaced apart a predetermined distance in the horizontal direction and which deck members extend a predetermined distance in the horizintal direction. As may be best seen in FIG. 4, the deck members 28 reside on the joist 27. Each deck member 28 includes a horizontal member 29 for receiving a load applied to the support apparatus or deck panel (a load applied for example by a player running across the deck panel), and such deck member 28 further includes a plurality of integrally formed and vertically disposed legs 31 for providing the deck member with resistance to bending in the vertical direction; the legs 31 of the deck members 28 being fixedly secured to the joists, such as for example by welding, as shown in FIG. 4.

The pair of channel members 24 of each deck panel 22 provides the deck panel 22 with resistance to bending in the vertical direction; and the plurality of joists 27 of each deck panel provide the deck panel with resistance to bending in the vertical direction.

As is shown in FIG. 4, adjacent deck panels 22 (adjacent as shown in FIG. 2) may be secured together, such as for example, by threaded fasteners 33.

It will be understood by those skilled in the art that a plurality of support apparatus or deck panels 22 may be fabricated at a distant factory and transported to a distant platform tennis site and assembled in a rectangular configuration as shown in FIG. 2. The joists 27 of the deck panels may be supported by I-beams 34 which I-beams in turn may be supported by pilings 36 as shown in FIG. 2.

Secured to the outer rectangular periphery of the assembled deck panels 22 is the screen and screen support and tensioning apparatus 30 of FIG. 1. As shown in FIG. 1, such screening support and tensioning apparatus includes a plurality of vertically disposed metal support members 40 spaced apart horizontally a predetermined distance around the rectangular outer periphery of the deck panels 22 and arranged rectangularly into four sections 42, 44, 46 and 48. Each of said sections includes a plurality of the aforementioned vertical metal support members 40 as may best be seen in FIG. 5. As shown in FIG. 5, the lower portion of such vertical support member 40 is secured to the outer periphery of a deck panel 22 by being, for example, bolted to the channel 24 of the deck panel as shown, In addition, each section of screen support and tensioning apparatus 42, 44, 46 and 48 may further include a first metal transverse support member 52 secured to the upper portion of the vertical support members 40, such as for example, by welding. Further included in a second metal transverse member 54 displaced downwardly from the first transverse member 52 a predetermined vertical distance and positioned at a second predetermined vertical position as shown in FIG. 5. The second transverse member 54 is structurally independent of the vertical support members 40 and movable vertically with respect thereto.

A body of screen material 60 is provided, as is known in the platform tennis court art, for providing a rebound surface for the ball used in playing platform tennis. The top of the screen material 60 is supported by the first transverse member 52, and may for example, be fixedly secured directly to the member 52 such as for example by metal stitching. The bottom of the screen material 60 is supported by the lower transverse member 54 and may be secured thereto, such as for example, by metal stitching.

Provided on the vertical support member 40, displaced downwardly from the second transverse member 54 are shock absorber means 70 interconnected with the second transverse member 54 and for applying downward force to the transverse member 54 to maintain the screen material 60 normal in tension and for permitting the transverse member to move upwardly, and the screen material to distend outwardly toward the vertical support 40, upon the application of a load or force to the screen material applied, for example, by a lunging player crashing into the screen material.

More specifically, the shock absorber 70 includes a housing 72 secured, such as for example by welding, to the vertical support member 40 and which housing has an aperture 73 provided in the top thereof. The transverse member 54 is also provided with one or more apertures in axial alignment with the aperture 73 and through which apertures is inserted a headed bolt 74 which also extends into the housing 72 and through a coil spring 78 residing within the housing 72. The shock absorber further includes a threaded fastener 80 engaging the end of the bolt residing in the housing and which threaded fastener, upon engaging the bolt comprising a spring 78 whereby the spring applies downwardly acting force, indicated by arrows 82 to normally maintain the screen 60 in tension, and which compression spring is further compressible in response to a load (the aforementioned lunging player) applied to the screen to permit the upward vertical movement of the transverse member 54, and which spring, being in compression, will upon the removal of the load from the screen further apply the downwardly acting force 82 to return the transverse member to its normal downward vertical position, and to again place the screen material 60 in tension.

Referring again to FIGS. 3 and 4, and in particular to FIG. 4, it will be noted that only the lower flanges 26 of the channel members 24 are in engagement with the I-beam 34 and that neither the joists 27 nor the deck members 28 are in engagement with the I-beam 34. Hence, as may be best seen in FIG. 4, the lower flange of the joist 27 is displaced from the I-beam 34 and hence if a load (a load applied by a player running across the deck member 28), were to apply a load directly over the point at which the channel member 24 is supported by the I-beam 34, the player would experience at least some deflection of the deck panel since between his foot and the I-beam 34 would be the deck member 28, capable of deflection in the vertical direction. Further, were such a player to apply a load over the vertical alignment of a deck member 28, channel 26 and where such channel is supported by an I-beam 34, the player would again experience more deflection as the joist 27 would deflect in the vertical direction due to the space between the bottom of the joist 27 and the I-beam 34 provided by the flange 26 of the channel member 24. Hence, a player moving or running across the support apparatus or deck panel 22 of the present invention, and in particular the assembly thereof shown in FIG. 2, will experience a more uniform deflection at any point thereover than he would in the above-mentioned wooden platform tennis court deck. Such uniform deflection, it will be understood, in addition to the explanation set forth above, would be provided by the flexibility of the channels 24, the deck members 28 and the joist 27, which members respectively are so flexibile alone that they would not support a running player's weight, but when structured in accordance with Applicant's present invention will not only support such a player but will provide uniform deflection in response to his weight.

Referring now to FIGS. 6 and 7, there are shown alternate embodiments of the manner in which the top of the screen 60 is supported by the upper transverse member 52. As shown in FIG. 6 the present invention may include a third transverse member 90 to which the screen 60 may be secured, such as fixedly secured by metal stitching or metal staples 96, and which member 90 may be removably secured to the transverse member 52 by threaded fasteners 91. Referring to FIG. 7, the third transverse member 92 may be removably secured to the transverse member 52 by such members having complementary portions 94 which are engageable as shown in FIG. 7 to removably secure the member 92 to the transverse member 52. It will be understood by those skilled in the art that the above recited expressions vertically and horizontally, with regard to the description of the deck members 28, joists 27 and channels 24 were merely used for convenience of description and merely describe the orientation of such members when used as the deck of a platform tennis court.

It will further be understood by those skilled in the art that many modifications and variations may be made in this invention without departing from the spirit and scope thereof.

What is claimed is:

1. Support apparatus for residing on apparatus support members, comprising:

a pair of oppositely disposed metal channel members spaced a predetermined distance apart in the horizontal direction and extending a predetermined distance in the horizontal direction, each of said channel members being of generally E-shaped crosssectional configuration and including a plurality of integrally formed and horizontally disposed flanges aligned vertically and spaced apart vertically predetermined distances, said flanges providing said channel members with resistance to bending in the horizontal direction, the flanges formed on each channel member extending towards the flanges formed on the other channel member, the lower two flanges on each channel member for receiving the ends of metal joists therebetween, and the upper and lower flanges on each channel member defining the top and bottom of said channel members;

a plurality of vertically disposed metal joists spaced apart predetermined distances in the horizontal direction and extending between said channel members and perpendicular thereto, the ends of said joists being received between said lower two flanges formed on said oppositely disposed channel members, whereby said joists are supported upwardly of the bottoms of said channel members and whereby said bottoms of said channel members define the bottom of said support apparatus and whereby upon said support apparatus residing on said apparatus support members only said bottoms of said channel members engage said apparatus support members and said joists are elevated above said apparatus support members, and said joists being fixedly secured to said channel members;

a plurality of metal deck members spaced apart a predetermined distance in the horizontal direction and said deck members extending a predetermined distance in the horizontal direction and parallel with said channel members, said deck members residing on said joists, each of said deck members being of generally -shaped cross-sectional configuration and including a horizontal member for receiving a load applied vertically downwardly to said support apparatus and said horizontal member having a plurality of integrally formed and vertically disposed and downwardly extending legs for providing said deck member with resistance to bending in the vertical direction but allowing some deflection downwardly of said deck members upon said load being applied thereto directly over said legs, and the bottoms of said legs of said deck members being fixedly secured to the tops of said joists, the outer portion of the horizontal members of said outer deck members extending over said tops of said channel members whereby said load can be applied directly only to said deck members and upon said load being applied to said deck members directly over the tops of said channel members, said outer portions of said deck members providing at least some deflection downwardly;

said pair of channel members for providing said support apparatus with resistance to bending in the vertical direction; and said joists for providing said support apparatus with resistance to bending in the vertical direction and upon said load being applied to said deck members directly over the points at which said legs of said deck members engage said joists said joists providing at least some downward deflection due to said elevation of said joists above said apparatus support members by said bottom flanges of said joists.

2. Support apparatus according to claim 1 wherein said recited metal is an aluminum alloy.

3. Support apparatus according to claim 1 wherein said pair of channel members and said joists are perpendicular to each other.

4. Support apparatus according to claim 1 wherein said deck members are parallel to said channel members and perpendicular to said joists.

5. Support apparatus according to claim 1 wherein said joists are fixedly secured to said channel members by welding.

6. Support apparatus according to claim 1 wherein said deck legs are secured to said joists by welding.

* * * * *